US006845282B2

(12) United States Patent
Franz

(10) Patent No.: US 6,845,282 B2
(45) Date of Patent: Jan. 18, 2005

(54) METHOD OF CONTROLLING TENSION IN A WEB

(75) Inventor: Michael Joseph Franz, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/234,735

(22) Filed: Sep. 4, 2002

(65) Prior Publication Data

US 2004/0044432 A1 Mar. 4, 2004

(51) Int. Cl.[7] ..... G06F 19/00
(52) U.S. Cl. ..... 700/122; 700/127
(58) Field of Search ..... 700/117, 122, 700/126, 127, 128, 129; 242/421.1–421.5

(56) References Cited

U.S. PATENT DOCUMENTS

| | | | | |
|---|---|---|---|---|
| 3,768,286 A | | 10/1973 | Peterson | |
| 4,151,594 A | | 4/1979 | Stern | |
| 4,378,213 A | | 3/1983 | Severy | |
| 5,223,778 A | * | 6/1993 | Svarovsky et al. | 318/610 |
| 5,269,222 A | | 12/1993 | Johnson et al. | |
| 5,455,764 A | * | 10/1995 | Meihofer | 700/41 |
| 5,730,693 A | | 3/1998 | Krayenhagen | |
| 5,894,797 A | | 4/1999 | Brennan et al. | |
| 5,937,756 A | | 8/1999 | Kishine et al. | |
| 5,964,390 A | | 10/1999 | Borresen et al. | |
| 5,992,789 A | | 11/1999 | Lamothe | |
| 5,996,492 A | * | 12/1999 | Jurkewitz et al. | 101/228 |
| 6,012,669 A | | 1/2000 | Tharpe, Jr. et al. | |
| 6,106,177 A | | 8/2000 | Siegl et al. | |
| 6,193,184 B1 | | 2/2001 | Hansen | |
| 6,314,333 B1 | | 11/2001 | Rajala et al. | |
| 6,317,637 B1 | | 11/2001 | Limroth | |
| 6,355,139 B1 | | 3/2002 | Baggot et al. | |
| 6,433,499 B1 | * | 8/2002 | Cote et al. | 318/432 |
| 2003/0010455 A1 | * | 1/2003 | Henry et al. | 156/363 |
| 2003/0169010 A1 | * | 9/2003 | Tomita | 318/652 |

FOREIGN PATENT DOCUMENTS

JP 10-250888 A 9/1998

OTHER PUBLICATIONS

Kihong Park, Hoseong Kim and Jeong Ho Hwang, Design of an Adaptive Tension/Velocity Controller for Winding Processes, ISIE 2001 IEEE Intern Symp On Industrial Electronics Proc., Pusan, Korea, pp. 67–72.

Karl N. Reid, Kee–Hyun Shin, and Ku–Chin Lin, Variable–Gain Control of Longitudinal Tension in a Web Transport System, ASME 1992, AMD–vol. 149, Web Handling, pp. 87–100.

Y. Hou, Z. Gao, F. Jiang and B. T. Boulter, Active Disturbance Rejection Control for Web Tension Regulation, 2001 IEEE Conference on Decision and Control, pp. 1–17.

Anne Angermann, Maik Aicher, and Dierk Schröder, Time–Optimal Tension Control for Processing Plants with Continuous Moving Webs, 2000 IEEE, Institute for Electrical Drive Systems, pp. 3505–3511.

(List continued on next page.)

*Primary Examiner*—Leo Picard
*Assistant Examiner*—Zolla Cabrera
(74) *Attorney, Agent, or Firm*—David K. Mattheis; David M. Weirich; Ken K. Patel

(57) ABSTRACT

A method of controlling tension in a material handling process. An error signal of the process is determined. The velocity analog value of the material is determined and an instantaneous integral gain is then determined according to the velocity analog value. A proportional gain is determined. The output of a controller is then adjusted according to the error signal, the instantaneous integral gain, and the proportional gain.

16 Claims, 1 Drawing Sheet

OTHER PUBLICATIONS

Hakan Koç, Dominique Knittel, Michel De Mathelin, and Gabriel Abba, Modeling and Robust Control of Winding Systems for Elastic Webs, 2002 IEEE Transactions on Control Systems Technology, vol. 10, NO. 2, Mar. 2002, pp. 197–208.

Edouard Laroche, Hakan Koç, Dominique Knittel, Michel De Mathelin, Web Winding System Robustness Analysis via $\mu$–Analysis, 2001 IEEE International Conf on Control Applications, pp. 948–953.

D. Knittel, E. Laroche, H. Koç, Tension Control for Winding Systems With Two Degrees of Freedon H∞ Controller, 2001 IEEE Industry Application Conf., pp. 576–582.

Hakan Koç, Diminique Knittel, Michel De Mathelin and Gabriel Abba, Robust Gain–Scheduled Control in Web Winding Systems, 2000 IEEE Conf on Decisin Ad Controls, pp. 4116–4119.

Siddharth P. Nagarkatti, Fumin Zhang, Christopher D. Rahn and Darren M. Dawson, Tension and Speed Regulation for Axially Moving Materials, Journal of Dynamic Systems, Measurement, and Control, 2000 ASME, Sep. 2000, vol. 122, p. 445–453.

Tetsuzo Sakamoto, Yasunobu Izumihara, Decentralized Control Strategies for Web Tension Control System, 1997 ISIE, Guimaráes, Portugal, p. 1086–1089.

* cited by examiner

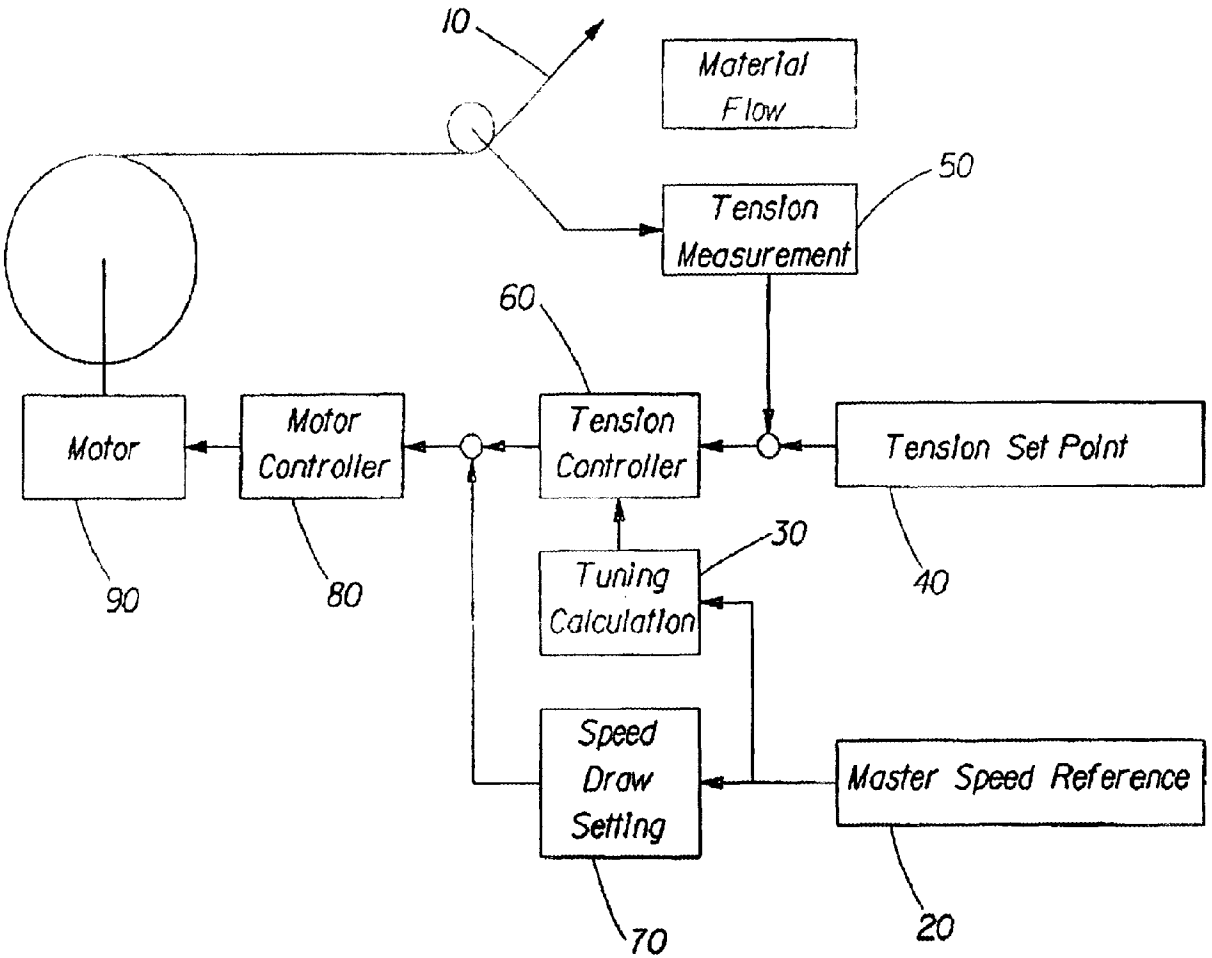
Material Flow
Tension Measurement
50
Tension Set Point
40
Master Speed Reference
20
30
Tension Controller
Tuning Calculation
Speed Draw Setting
70
60
10
Motor Controller
80
Motor
90

METHOD OF CONTROLLING TENSION IN A WEB

FIELD OF THE INVENTION

The invention relates to the control of tension in a material handling process. More particularly, the invention relates to the control of tension in a paper web during the process of converting the paper web.

BACKGROUND OF THE INVENTION

A variety of manufacturing processes handle continuous materials under tension. Wire, rope, thread, fiber optic filaments, films, paper webs, metal foils, ribbon, and other continuous materials are commonly processed under tension. The material may be handled under tension during the initial phases of processing, during intermediate phases and/or in the final phase of processing into a finished product. The uniformity of the finished product in these processes may depend upon the uniformity of the tension of the material as it is processed. The processing of materials having low tensile strengths requires maintaining process tension levels within narrow ranges to prevent breakage of the material and the corresponding loss of process productivity.

Automated process controllers such as Proportional+Integral (PI), and Proportional+Integral+Derivative (PID) controllers are used to control material tension during processing. PI, and PID controllers, calculate an error signal as the difference between a parameter set point and the measured value of the parameter. The output of the controller is then modified according to the error signal and one or more "gains" of the controller. The output is a function of the error signal and the gains. The calculation of the output may also involve constant terms. In instances where the values of controller gains are fixed, the gains are constant terms and the output is a function of the error signal. This is an iterative, feedback loop, process. The controller gains are named for their relationship to how the error signal is used. The proportional gain is used to compute output correction in proportion to the error signal. The integral gain is used to compute output correction according to the sum, or integral, of a value derived from the error signals. The derivative gain is used to compute output correction in relation to the rate of change, or derivative, of the error signal, or another signal such as the loop feedback.

Typical prior art control methods are "tuned" or optimized, by selecting appropriate controller gain values to achieve a desired process stability and rate of response. The controller gain values may be adjusted by process operators, these adjustments are manual and are related to changes in the incoming material or the process equipment performance. In some methods, the values of the controller gains are scheduled to change with the diameter of the roll of material as it is wound or unwound depending upon the specifics of the process being controlled.

Typical control methods do not provide adequate tension control at low process speeds. Typical loop tuning methods result in tension control over a speed range from a maximum speed to approximately one-tenth the maximum speed. These methods generally become too unstable and oscillatory at lower speeds. Some methods remain stable at lower speeds but sacrifice the ability to respond to rapidly changing process conditions at low speeds.

The inability to control the material tension at low speeds results in a loss of tension control during the ramp up and ramp down phases of the process. Loss of control at these times results in undesirable material breaks, increased process waste, and lost productivity. The lack of adequate tension control at low speeds and also the absence of adequate control system response to changes in the modulus of elasticity of the material being processed also results in non-uniform finished products that must be disposed of as waste.

SUMMARY OF THE INVENTION

The invention comprises a method for controlling the tension of a continuous material during the processing of the material. The method provides tension control of the material over the full speed range of the process. The method controls tension as the speed, the modulus of elasticity, and/or the wound tension of the material changes.

In on embodiment the method comprises the steps of: determining an error signal in the controlled process, determining the instantaneous integral gain according to the velocity analog value of the material in process, and determining a proportional gain.

In another embodiment the method comprises the steps of: determining a set point for the tension of the material, measuring the tension of the material, determining the tension error, determining the velocity analog of the material, determining a proportional gain, determining the instantaneous integral gain of the process according to the velocity analog, and adjusting the process output according to the tension error, the proportional gain and the integral gain.

DESCRIPTION OF THE FIGURES

FIG. 1 is a schematic block diagram of a segment of a material handling process utilizing the method of the invention.

DETAILED DESCRIPTION OF THE INVENTION

Definitions

Controller correction calculation: the calculation made by a controller based upon an error signal, and the gains of the controller to reduce the error signal.

Error signal: the difference between a parameter set point and the measured value for the parameter.

Gain: a mathematical construct that relates a controller output, or a process unit, to a controller input.

Integral gain: a factor used in calculating the correction to the output of a process based on the integral of a value derived from the error signal. Integral gains are used in Integral controllers, Proportional+Integral controllers, and Proportional+Integral+Derivative controllers.

Instantaneous integral gain: the value of the integral gain determined by a controller tuning calculation at a particular instant in time. The instantaneous gain may be calculated at any instant according to a process variable. The value of the gain may change according to the change in the value of the variable over time. As a non-limiting example, instantaneous integral gain may be varied according to the velocity analog value of a handled material.

In one embodiment the value of the instantaneous integral gain is used directly in the controller correction calculation as the instantaneous integral gain is calculated. In another embodiment, the value of the instantaneous integral gain may be smoothed, averaged, or filtered, using mathematical functions as are known in the art, prior to the use of the gain in the controller correction calculation. In any embodiment, a time delay may be used to offset the time of determining the value of the instantaneous integral gain and the time of the use of the newly determined value of the gain in the controller correction calculation.

Lower limit instantaneous integral gain: the value of the integral gain at a selected lower limit material velocity analog value.

Master speed reference: a master value used to synchronize speed changes across a process using multiple drives and controllers.

Maximum velocity: the maximum material velocity attainable in a material handling process.

Output: the control signal disseminated to the object(s) of a controller.

Proportional gain: a factor used in calculating the correction to the output of a process controller based on the error signal.

Span: the length between successive drive components in a material handling process.

Speed draw setting: a control factor used to compensate for differences in process requirements in different portions of a material handling process. The speed draw setting is used to offset the speed of a process section from a master speed reference.

Tension set point: the desired material tension in a material handling process.

Tuning calculation: a calculation to determine a value for a gain.

Velocity analog value: a factor analogous to the speed of the material in a material handling process. The analog value may be derived from direct measurement of the velocity of the material or may be derived from a master speed reference for the process.

The method of the invention may be practiced in a material handling process having a single driven segment, or multiple driven segments. In a multi segment process, the method may be practiced on a single segment or multiple segments as desired. A process segment is defined as a portion of the process between two drives, an upstream drive and a downstream drive. The upstream drive is the drive unit located at the beginning of a process segment. The downstream drive is the drive located at the end of a process segment.

The method may be used to control the material tension in a segment by controlling the speed of the upstream drive, the downstream drive, or both the upstream and downstream drives. Controlling the tension by adjusting the speed of the upstream drive may require additional adjustments to the speeds of drives further upstream. Additional adjustments may be required for all upstream drives from the controlled process segment upstream drive, to the initial drive of the process.

Increasing the speed of the upstream drive will reduce the tension in the segment. Decreasing the speed of the upstream drive will increase the tension in the segment. Increasing the speed of the downstream drive increases the tension and decreasing the speed of the downstream drive decreases the tension.

The method is described controlling the tension in a paper web during the process of converting the web from parent rolls to finished products. One of skill in the art understands that the method is not limited to this use and is applicable to any process wherein a continuous material is processed under tension.

According to FIG. 1, the tension in paper web 10 is controlled by the speed difference between the speed of upstream motor 90, and the downstream drive (not shown). This speed difference may be altered by adjusting the output of tension controller 60 to raise or lower the speed of upstream motor 90 via motor controller 80. Raising the speed of the upstream motor 90 relative to the downstream motor (not shown) will reduce the tension of the web 10, and lowering the speed of the upstream motor 90 relative to the downstream process will increase the tension of the web 10.

The output of the controller 60 is adjusted according to the error signal and the gains of the controller 60. The error signal, the proportional gain and the instantaneous integral gain are used in the controller correction calculation to adjust the controller output to reduce the magnitude of the error signal as is known in the art. The method of the invention determines the instantaneous integral gain of the controller 60 according to the velocity analog value of the web 10 resulting in effective web-tension control over the entire speed range of the web converting process and also accommodates variations in the modulus of elasticity of the web 10, or the wound tension of the web 10.

The method may be practiced using any controller 60 that uses the integral of a value derived from the error signal to derive the controller output correction. An exemplary controller for practicing the method of the invention is a Universal Drive Controller card, in a Reliance Automax Distributed Control System available from Reliance Electric, Mayfield Heights, Ohio.

A tension set point, correlated to the desired tension, is determined for the process. The value of the set point is input into the controller. The web tension used to determine the error signal may be measured at any point in the process span where tension is being controlled. Web tension is typically measured by routing the web 10 around a process element attached to a load cell. An exemplary sensor for measuring tension is a Tensioncell 30, available from Comptrol Inc., Cleveland, Ohio. The error signal is then determined as the difference between the tension set point, and the measured tension.

In one embodiment, the instantaneous integral gain is determined using a maximum integral gain and the web velocity analog value. Maximum integral gain is calculated according to the ratio of the maximum speed of the process and the span of the controlled segment of the process. The maximum integral gain used in the tuning calculation may be based on either the ratio of maximum speed to span length or the reciprocal of the ratio depending upon the specific units of integration used in the controller. The instantaneous integral gain is then varied according to the ratio of the web velocity analog value and the maximum speed set point.

In another embodiment, the instantaneous integral gain is determined according to the web velocity analog value and the span of the process segment without consideration of the maximum process speed or the maximum integral gain. The instantaneous integral gain used in the controller correction calculation may be based on either the ratio of the web velocity analog value to the process span length or the reciprocal of the ratio depending upon the specific units of integration used in the controller.

The web velocity analog value may be set equal to the master speed reference 20 used to synchronize speeds in the web handling process. Alternatively, the web velocity analog value for a particular segment may be derived from measuring the web velocity in the controlled segment. When the web velocity is measured the analog value may be set equal to the instantaneous value of the web velocity or to a mathematically filtered value of the velocity, to reduce the effects of sudden changes in the velocity. The instantaneous value of the web velocity may be filtered through the use of mathematical smoothing functions as are known in the art.

As the velocity of the web 10 changes, the value of the instantaneous integral gain is recalculated and the controller 60 utilizes the new value of the instantaneous integral gain to determine the correction in the controller output necessary to reduce the tension error value.

Particular controller 60 hardware and/or software may limit the lowest velocity analog value for which an instantaneous integral gain is calculated. The value of the lower limit is determined according to the specific details of the controlled process. In one embodiment the instantaneous integral gain value is fixed at any web velocity analog value less than 1% of the maximum process speed. In another embodiment the integral gain value is fixed at any web velocity analog value less than 0.1% of the maximum process speed. The speed at which the lower limit of the instantaneous integral gain is determined is not limited to the above mentioned embodiments. The lower limit speed may be any speed less than the maximum speed of the process. A lower limit instantaneous integral gain is determined for a selected lower limit web velocity analog value. The lower limit instantaneous integral gain is then used at any web velocity analog value less than or equal to the lower limit web velocity analog value.

Prior art loop control methods utilize the proportional gain as the primary means of tuning the loop. Adjusting the instantaneous integral gain according to changes in the web velocity analog value provides rapidly responding, stable tension control over the full speed range of a process. Unlike the prior art, the method of the invention use the proportional gain to accommodate changes in process conditions. As an example, the adverse impact on web tension caused by an out-of-round roll of web may be reduced through the adjustment of the proportional gain. The proportional gain may be set to a high value at low speeds and then reduced according to changes in the web speed to reduce the undesirable effects caused by an out-of-round roll of web. In another embodiment, the proportional gain is selected to provide an adequate response across the process speed range and left unchanged.

The method does not preclude the use of the derivative gain to accommodate sudden large changes in the error signal in a process utilizing a PID controller. An auxiliary proportional gain may also be added to the calculations of the controller. The auxiliary proportional gain modifies the output of the control loop to increase the range of control available and/or provides another means of accommodating process changes.

Multi-segmented web handling processes may have process tension requirements that are unique to the respective process segments. As an example, a process for converting parent rolls of a paper web material into finished paper products may comprise a segment to unwind the parent roll, a segment to emboss the web, a segment to print on the web, and a segment to wind the printed and embossed web. Each segment may require different web tensions for optimal performance. The method as set forth above may be used to control such a multi-segmented process. The additional step of incorporating a speed draw setting 70 into the control method of the invention provides for a more refined level of control.

For each segment of the process, a speed draw setting 70 is determined based upon the Operator's assessment of the tension desired for that segment. The speed draw setting 70 is determined for any particular segment tension desired. The speed draw setting 70 adjusts the speed of the segment from the master speed reference 20 to establish a base operating point for the segment tension. The master speed reference 20 is modified according to the speed draw setting 70 to determine a local speed reference for the motor controller 80. The web tension is then controlled using the method as disclosed above to maintain the segment process tension.

An additional feedback loop may be utilized to calculate the speed draw setting 70 according to the controller correction calculation. In this embodiment, the speed draw setting 70 is recalculated to reduce the controller correction to zero. Recalculating the speed draw setting 70 to reduce the controller correction maintains the output of the controller 60 in a preferred range.

The method of the invention may be used in any process computing an output correction based on the integral of a value derived from the error signal to handle a material under tension. As non-limiting examples, the method may be used in the handling of wire, rope, thread, fiber optic filaments, films, paper webs, metal foils, ribbon, or any other material that is processed under a drawing tension.

What is claimed is:

1. A method of adjusting an output in a process for handling a material having a velocity analog value, the method comprising the steps of:

a) determining an error signal;

b) determining an instantaneous integral gain according to the velocity analog value;

c) determining a proportional gain; and d) adjusting a process output according to the instantaneous integral gain and the proportional gain.

2. The method of claim 1 wherein the error signal comprises a tension error signal.

3. The method of claim 1 wherein the step of determining the instantaneous integral gain according to the velocity analog value further comprises the steps of:

a) determining a maximum velocity;

b) determining the integral gain for the maximum velocity;

c) determining the velocity analog value; and d) determining the instantaneous integral gain according to the velocity analog value and the maximum velocity.

4. The method of claim 1 wherein the step of determining the instantaneous integral gain according to the velocity analog value further comprises the steps of:

a) determining the velocity analog value; and b) determining the instantaneous integral gain according to the velocity analog value and a span of the process.

5. The method of claim 1 further comprising the steps of:

d) determining a lower limit velocity analog value;

e) determining a lower limit instantaneous integral gain for the lower limit velocity analog value; and f) setting the value of the instantaneous integral gain equal to the lower limit instantaneous integral gain if the velocity analog value less than or equal the lower limit velocity analog value.

6. A method of controlling a process for handling a material having a velocity analog value, and a tension, the method comprising the steps of:

a) determining a set point for the tension;

b) determining the tension;

c) determining a tension error;

d) determining the velocity analog value;

e) determining an instantaneous integral gain according to the velocity analog value;

f) determining a proportional gain; and g) adjusting a process output according to the tension error, the proportional gain, and the instantaneous integral gain.

7. The method of claim 6 wherein the step of determining the instantaneous integral gain according to the velocity analog value further comprises the steps of:

a) determining a maximum velocity;

b) determining an integral gain for the maximum velocity; and c) determining the instantaneous integral gain according to the velocity analog value and the maximum velocity.

8. The method of claim 6 wherein the step of determining the instantaneous integral gain according to the velocity analog value further comprises the step of:

a) determining the instantaneous integral gain according to the velocity analog value and a span of the process.

9. The method of claim 6, further comprising the steps of:

h) determining a lower limit velocity analog value;

i) determining a lower limit instantaneous integral gain for the lower limit velocity analog value; and j) setting the value of the instantaneous integral gain equal to the lower limit instantaneous integral gain if the material velocity analog value is less than or equal to the lower limit velocity analog value.

10. The method of claim 6 further comprising the step of adjusting the proportional gain.

11. The method of claim 6 further comprising the step of adjusting the output according to a speed draw setting.

12. The method of claim 6 further comprising the step of adjusting the speed of a drive selected from the group consisting of: an upstream drive, and a downstream drive.

13. The method of claim 6 farther comprising the steps of:

h) adjusting the speed of at least one upstream drive; an i) adjusting the speed of at least one downstream drive.

14. The method of claim 6 further comprising the step of adjusting the speed of multiple upstream drives.

15. The method of claim 6 further comprising the step of selecting an auxiliary gain.

16. The method of claim 6 wherein the material comprises a paper web material.

* * * * *

UNITED STATES PATENT AND TRADEMARK OFFICE

CERTIFICATE OF CORRECTION

PATENT NO. : 6,845,282 B2
DATED : January 18, 2005
INVENTOR(S) : Michael Joseph Franz It is certified that error appears in the above-identified patent and that said Letters Patent is hereby corrected as shown below:

Column 8,
Line 16, “farther” should read -- further --.
Line 17, “an” should read -- and --.

Signed and Sealed this

Fifth Day of April, 2005

JON W. DUDAS
*Director of the United States Patent and Trademark Office*